US010316545B2

(12) United States Patent
Pirnar

(10) Patent No.: US 10,316,545 B2
(45) Date of Patent: Jun. 11, 2019

(54) DOOR HANDLE ASSEMBLY AND PROCESS FOR EXTENDING AND/OR RETRACTING OF DOOR HANDLE ASSEMBLY

(71) Applicant: PIRNAR, TRŽENJE, PROIZVODNJA IN RAZVOJ, D.O.O., Ljubljana (SI)

(72) Inventor: Gasper Pirnar, Ljubljana (SI)

(73) Assignee: PIRNAR, TRŽENJE, PROIZVODNJA IN RAZVOJ, D.O.O., Ljubljana (SI)

( * ) Notice: Subject to any disclaimer, the term of this patent is extended or adjusted under 35 U.S.C. 154(b) by 0 days.

(21) Appl. No.: 15/764,998

(22) PCT Filed: Mar. 9, 2016

(86) PCT No.: PCT/SI2016/000007

§ 371 (c)(1),
(2) Date: Mar. 30, 2018

(87) PCT Pub. No.: WO2017/155476

PCT Pub. Date: Sep. 14, 2017

(65) Prior Publication Data

US 2018/0283045 A1 Oct. 4, 2018

(51) Int. Cl.

| | |
|---|---|
| ***E05B 1/00*** | (2006.01) |
| ***E05B 5/02*** | (2006.01) |
| ***E05B 5/00*** | (2006.01) |
| *E05B 47/00* | (2006.01) |

(52) U.S. Cl.
CPC ..... *E05B 5/003* (2013.01); *E05B 5/006* (2013.01); *E05B 47/0012* (2013.01)

(58) Field of Classification Search
CPC . Y10T 16/458; Y10T 16/4554; Y10T 16/473; E05B 5/003; E05B 5/00; E05B 5/006; E05B 47/0012; E05B 2047/002; E05B 2047/0014; E05B 2047/0018
See application file for complete search history.

(56) References Cited

U.S. PATENT DOCUMENTS

| | | | | |
|---|---|---|---|---|
| 751,685 A * | 2/1904 | Sanford | ..... | B25G 1/04 16/429 |
| 2,260,785 A * | 10/1941 | Miguel | ..... | E05B 5/003 16/429 |
| 2,348,065 A * | 5/1944 | George | ..... | E05B 5/00 292/1 |

(Continued)

FOREIGN PATENT DOCUMENTS

| | | |
|---|---|---|
| EP | 1072466 | 1/2001 |
| EP | 1607556 | 12/2005 |

*Primary Examiner* — Chuck Y Mah
(74) *Attorney, Agent, or Firm* — Robert G. Lev

(57) ABSTRACT

This invention is directed to a door handle which is normally hidden within the door, be it either completely flush with a door surface, or partially protruding from said door surface. If a user wants to use the handle, then the user activates the handle using convention actuating techniques to extend the handle from the recess. Should an external object be placed between the handle and the door surface after the handle is operated and the retraction process begins, the handle movement is limited in the downward direction by the extension of an elastic link between the door handle and the rest of the retraction mechanism.

8 Claims, 7 Drawing Sheets

(56) References Cited

U.S. PATENT DOCUMENTS 2,599,054 A * 6/1952 Gates ..... E05B 5/003 292/348
3,431,586 A * 3/1969 Bush ..... A45C 13/26 16/405
3,572,870 A * 3/1971 Marks ..... A45C 13/22 16/405
3,744,084 A * 7/1973 Fankhouser ..... A45C 13/22 16/429
4,589,162 A * 5/1986 Manz ..... H05K 5/023 16/429
4,895,403 A * 1/1990 Osenkowski ..... E05B 85/107 16/412
5,001,809 A * 3/1991 Kim ..... E05F 3/14 16/62
5,193,666 A * 3/1993 Markowski ..... H01H 3/04 16/429
5,844,470 A * 12/1998 Garnault ..... E05B 81/20 340/5.62
5,961,194 A * 10/1999 Shaw ..... H05K 5/023 16/412
6,089,625 A * 7/2000 Prevot ..... E05B 65/087 292/140
6,397,436 B1 * 6/2002 Wang ..... A45C 13/26 16/114.1
7,108,301 B2 * 9/2006 Louvel ..... E05B 81/78 292/201
8,453,297 B2 * 6/2013 Wang ..... G06F 1/1616 16/114.1
9,103,143 B2 * 8/2015 Wheeler ..... E05B 85/00
9,518,410 B2 * 12/2016 Vasi ..... E05B 5/006
9,540,841 B2 * 1/2017 Vanderick ..... E05B 1/0015
2006/0090299 A1 * 5/2006 Liao ..... E05B 1/0015 16/405
2014/0265372 A1 * 9/2014 Smart ..... E05B 85/103 292/336.3
2015/0225979 A1 * 8/2015 Garofoli ..... E05B 63/042 292/336.3

* cited by examiner

DOOR HANDLE ASSEMBLY AND PROCESS FOR EXTENDING AND/OR RETRACTING OF DOOR HANDLE ASSEMBLY

PRIORITY INFORMATION

The present patent application is a National Stage Entry of PCT/SI2016/000007, filed on Mar. 9, 2016.

FIELD OF TECHNOLOGY

Door handle manufacture, structure, mounting and operation.

BACKGROUND

The technical problem to be overcome by present solution is lack of safety of a person closing or opening or otherwise engaging a door handle which is normally hidden in a recess made in said door. If door handle needs to be essentially flush with the surface of said door or at least partially retracted into said door, and also if its retraction is automated, there is clear and present danger of users' fingers or clothing, or other objects being caught between said handle and edge of said recess.

GB472359 describes a flush handle for the outside of vehicle doors. The handle moved into its recess when the latch is retracted either by the inside handle or by slamming the door.

KR20130063124 describes a handle housing mounted on the outer panel of a vehicle door and partitioned into a grip member and an opening and closing member. The door locking device is connected to the grip member and opens a door using a handle cable.

SUMMARY OF THE INVENTION

There are many door designs. Intrinsic to door design there is a handle for operating of said door, particularly for closing and opening of said doors. Said handle is usually seen to the outside user but in many instances said handle is flush with said door when not in use.

This invention deals with a door handle which is normally hidden within the door, be it either completely flush with a door surface, or partially protruding from said door surface. If a user wants to use said handle, said user activates said handle using state of the art actuating means. Said user may either depress said handle, or triggers mechanism by some other means such as breaking a light beam, actuating proximity sensor, depressing a button or some similar mechanism.

After said handle which has been hidden, either partially, or totally, within body of said door is activated, said handle emerges from a recess in which it was hidden. This can be achieved by means of springs, electric actuators, pneumatic cylinders, oil cylinders or some similar mechanism, or by rack and pinion mechanism as in preferred embodiment.

The inventive door handle assembly and process for its use solves the above-referenced technical problem by attaching the door handle to the door, or the door handle assembly base by at least one attachment means as well as providing a process during which safety features of said handle are utilized to prevent discomfort or even bodily harm of user of said handle.

After said handle has had emerged, said user may engage is by usually gripping it and proceeding with normal use of said handle.

The problem which is solved by this invention arises when accidentally, or by design, reverse mechanism for hiding of said handle is actuated, but said user has not yet removed their hand from said handle. As a result of said reverse mechanism, handle is returning to its recess within said door body, and traps said user extremity or plurality thereof such as a hand, finger, or plurality thereof between said handle and edge of said recess. Such a situation may result in bodily harm or unpleasant experience of said user.

It is therefore logical that some degree of safety must be provided for.

This invention provides for at least one, preferably flexible, attachment means between said handle and substructure of said handle and/or door. Preferably, these flexible attachment means is a helical spring, elastic ribbon, or plurality thereof.

BRIEF DESCRIPTION OF THE DRAWINGS

Below the invention is described in greater detail with help of figures, said figures forming part of this patent application.

FIG. 5 (*b*) shows door with handle in its retracted position outside the door body presenting handle (1), door body (2).

DETAILED DESCRIPTION OF PREFERRED EMBODIMENTS

Figure 1:
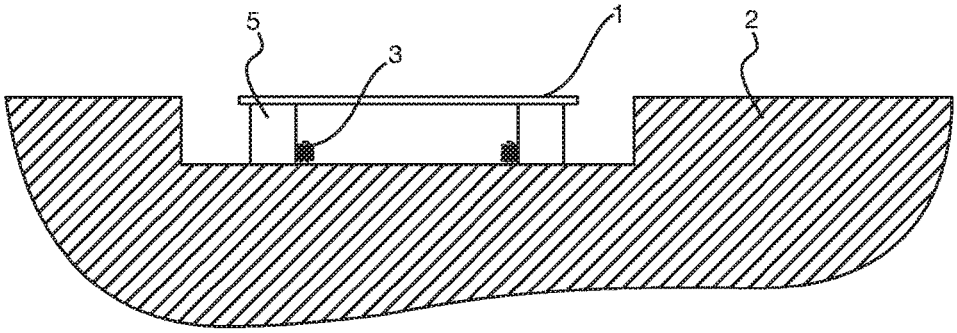
FIG. 1 shows handle in its retracted position inside the door body, presenting handle (1), door body (2), attachment means (3), handle connector (5).
Figure 2:
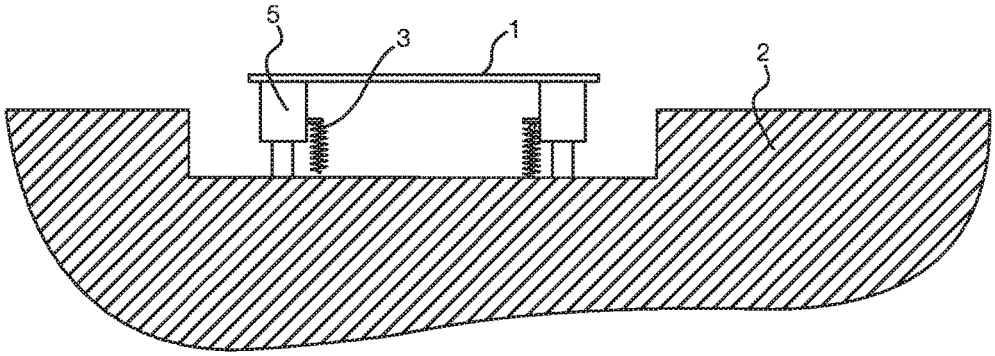
FIG. 2 shows handle in its extended position outside the door body, presenting handle (1), door body (2), attachment means (3), base connector (4), handle connector (5).
Figure 3:
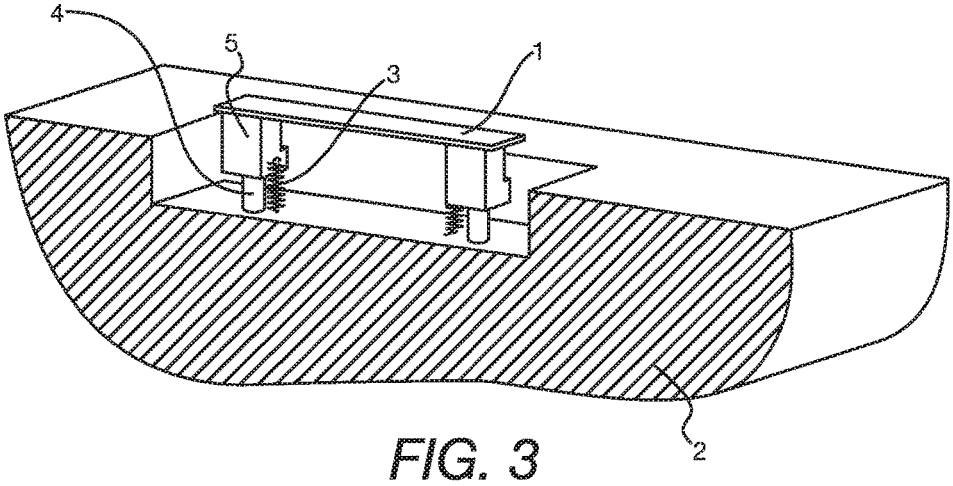
FIG. 3 shows handle in its extended position outside the door body, presenting handle (1), door body (2), attachment means (3), base connector (4), handle connector (5).
Figure 4:
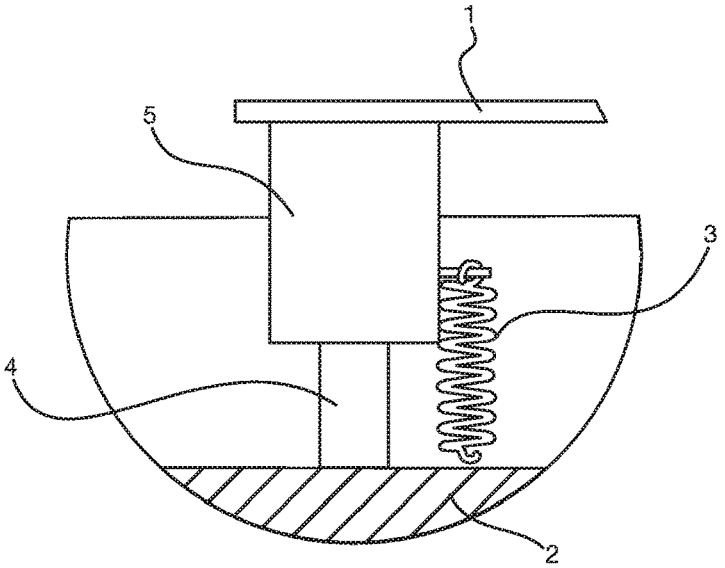
FIG. 4 shows enlarged portion of handle detail, presenting handle (1), door body (2), attachment means (3), base connector (4), handle connector (5).
Figure 5A:
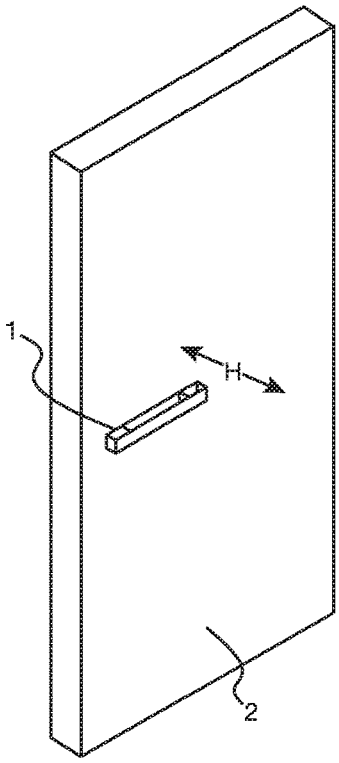
FIG. 5 (*a*) shows door with handle in its extended position outside the door body presenting handle (1), door body (2).
Figure 5B:
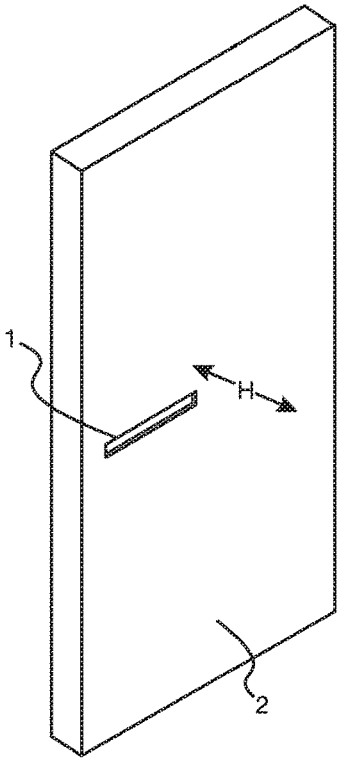

FIGS. 1 through 5 show door handle assembly and its process during operation with extending and retracting action performed by means of hydraulic or electric actuators. Said handle (1) is connected to handle connector (5). Said handle connector (5) is positioned onto base connector (4) allowing relative movement between handle connector (5) and base connector (4). Such arrangement provides for extending and retracting of handle (1) by sliding of said handle connector (5) up (to extend) and down (to retract) on base connector (4). In order for an assembly not to fall apart said handle connector (5) is attached to either door body (2) or base (6) with at least one attachment means (3), said attachment means (3) in this embodiment in form of helical spring.

It should be stated that figure show a handle with two handle connectors. There is no particular reason for that, it is solely an embodiment. The same effect is obtained by single handle connector (5) connected to said handle (1), having single attachment means (3).

Door handle assembly according to this invention is comprised of handle (1), said handle (1) connected to at least one handle connector (5), said handle connector (5) moveably connected to extending and/or retracting means by at least one attachment means (3), said attachment means (3) attached to door body (2) and/or base (6), said attachment means (3) allowing for relative movement between said handle connector (5) and said extending and/or retracting means during retraction of said handle (1) into a recess in order to limit amount of force exerted by said handle (1) on an obstacle between said handle (1) and edge of a said recess into which said handle (1) is retracted. In such a way user whose hand or finger or plurality thereof present an obstacle has on opportunity to remove his or her extremities without handle exerting too large of a force on them during retraction, if said user does not remove his or her extremities in time.

Figure 6:
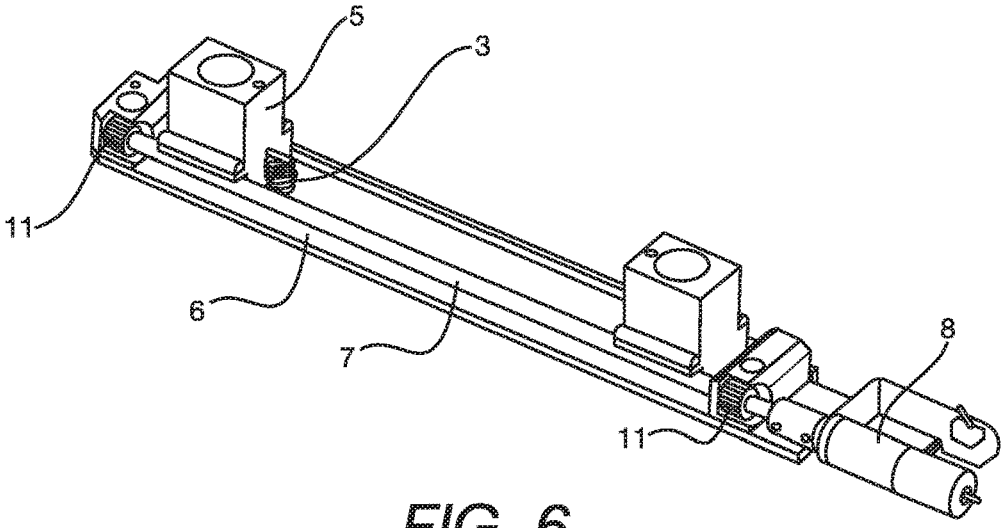
FIG. 6 shows part of door handle assembly in its preferred embodiment presenting attachment presenting attachment means (3), handle connector (5), base (6), axle (7), driving means, preferably electromotor (8), pinion (11).
Figure 7:
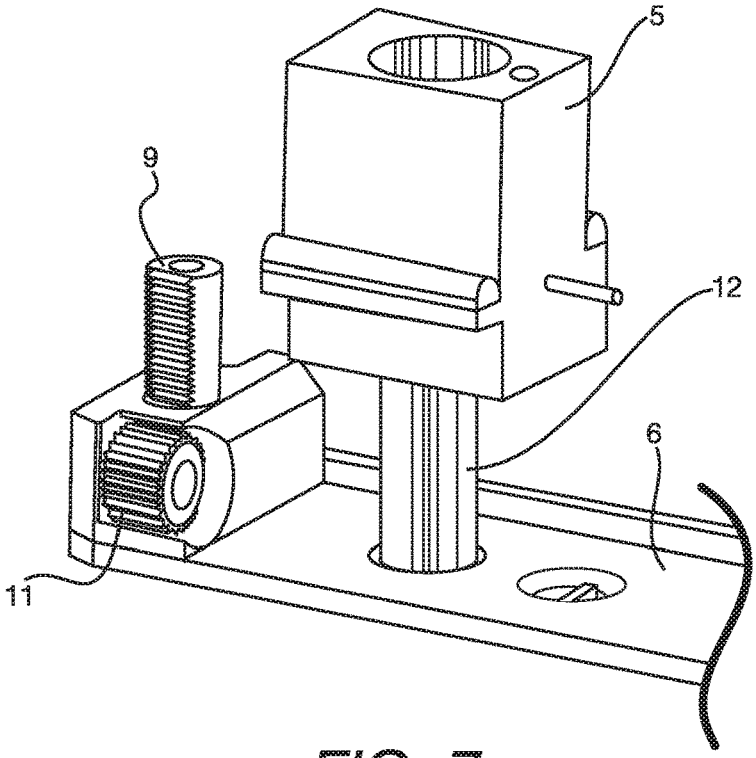
FIG. 7 shows part of door handle assembly in its preferred embodiment presenting handle connector (5), base (6), rack (9), pinion (11), cradle connector (12).
Figure 8:
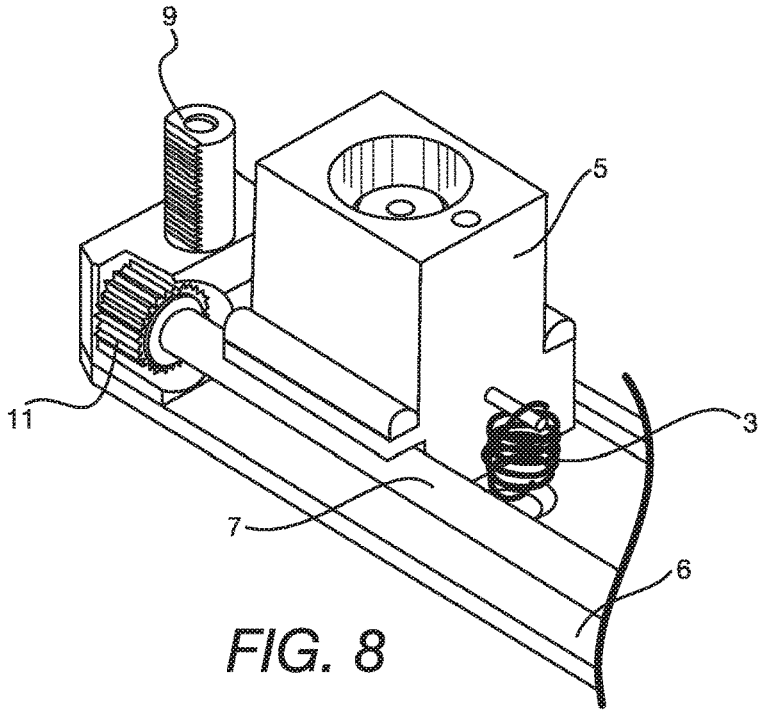
FIG. 8 shows part of door handle assembly in its preferred embodiment presenting attachment means (3), handle connector (5), base (6), axle (7), rack (9), pinion (11).
Figure 9:
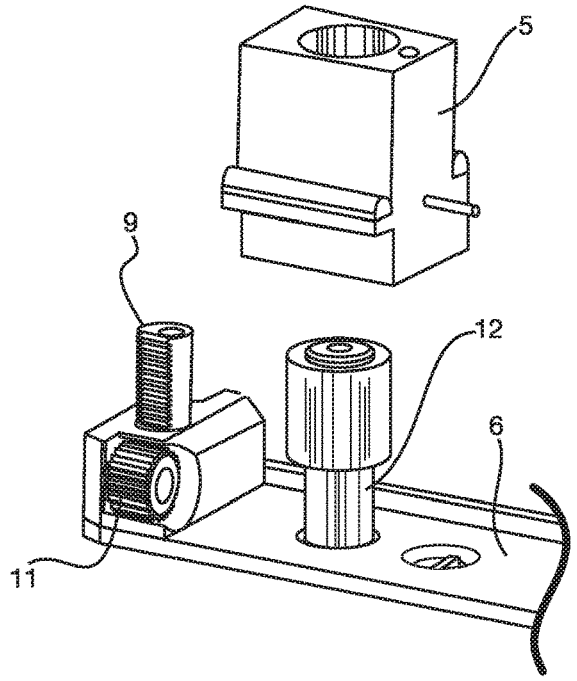
FIG. 9 shows part of door handle assembly in its preferred embodiment presenting handle connector (5), base (6), rack (9), pinion (11), cradle connector (12).
Figure 10:
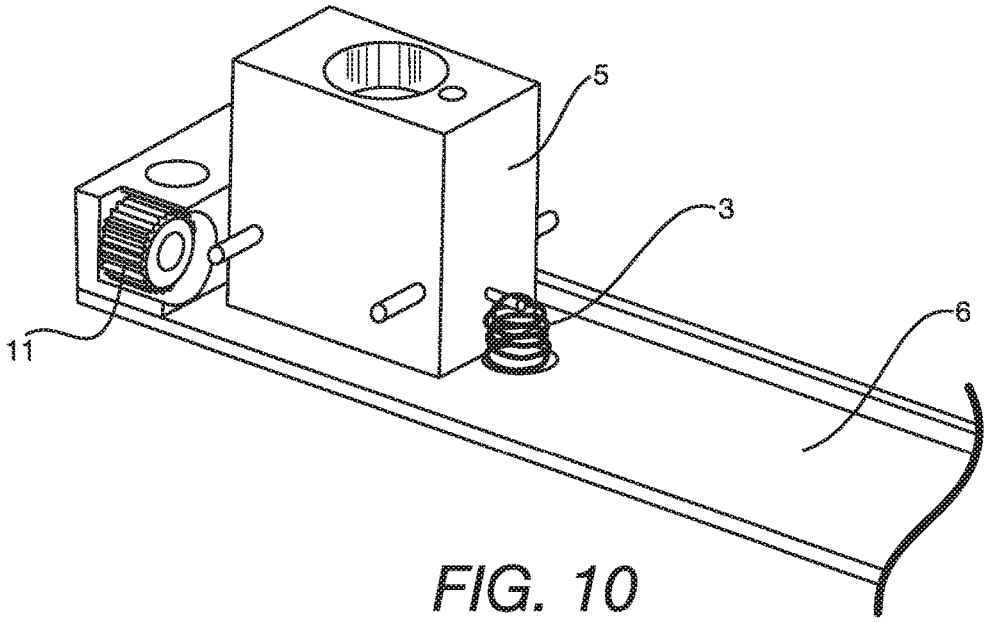
FIG. 10 shows part of door handle assembly in its preferred embodiment presenting attachment means (3), handle connector (5), base (6), pinion (11).
Figure 11:
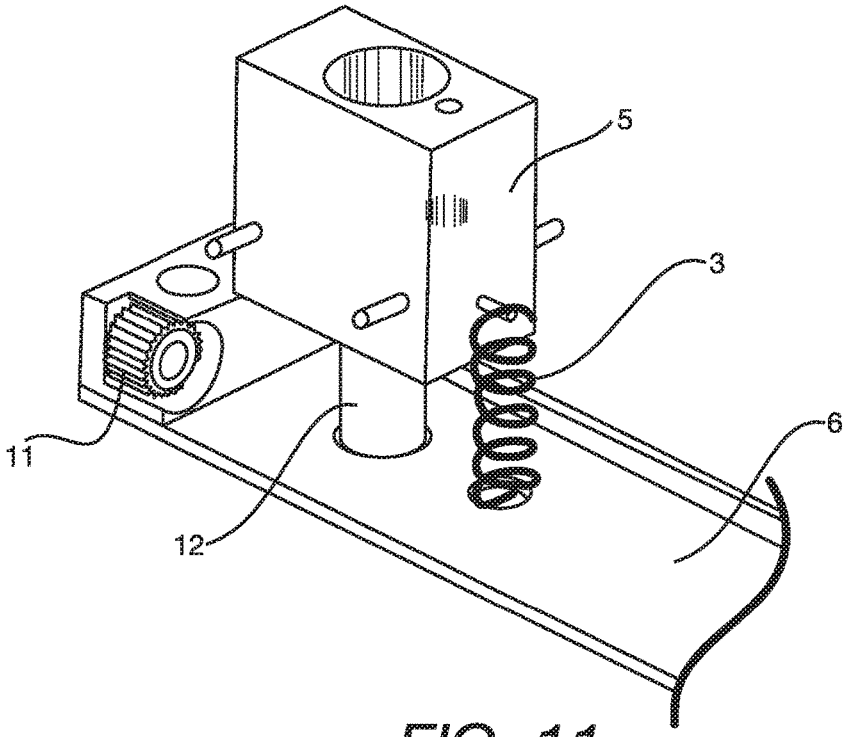
FIG. 11 shows part of door handle assembly in its preferred embodiment presenting attachment means (3), handle connector (5), base (6), pinion (11), cradle connector (12), showing behavior during process in which an obstacle is inserted between said door body (2) and said handle (1).
Figure 12:
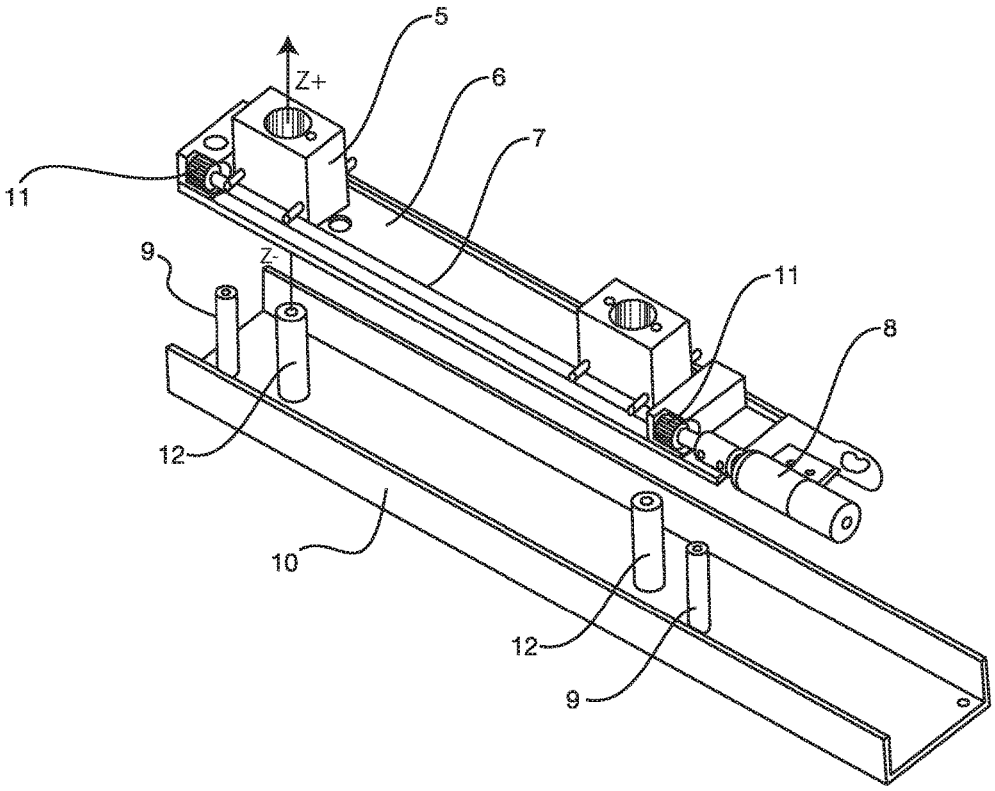
FIG. 12 shows door handle assembly in its preferred embodiment presenting handle connector (5), base (6), axle (7), driving means, preferably electromotor (8), rack (9), cradle (10), pinion (11), cradle connector (12).
Figure 13:
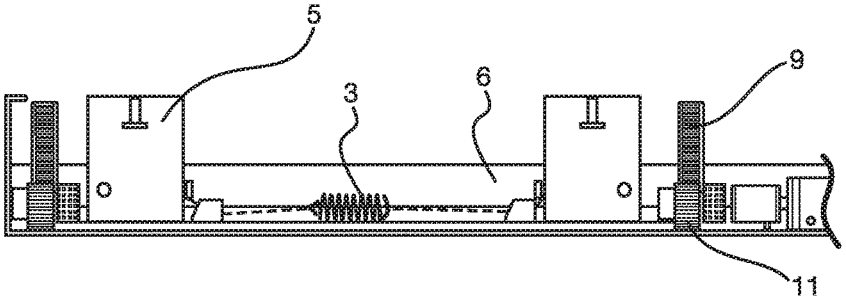
FIG. 13 shows a bit different embodiment in which instead of two attachment means only single attachment means (3) is used with two handle connectors (5), and shows attachment means (3), handle connector (5), base (6), rack (9), pinion (11).
Figure 14:
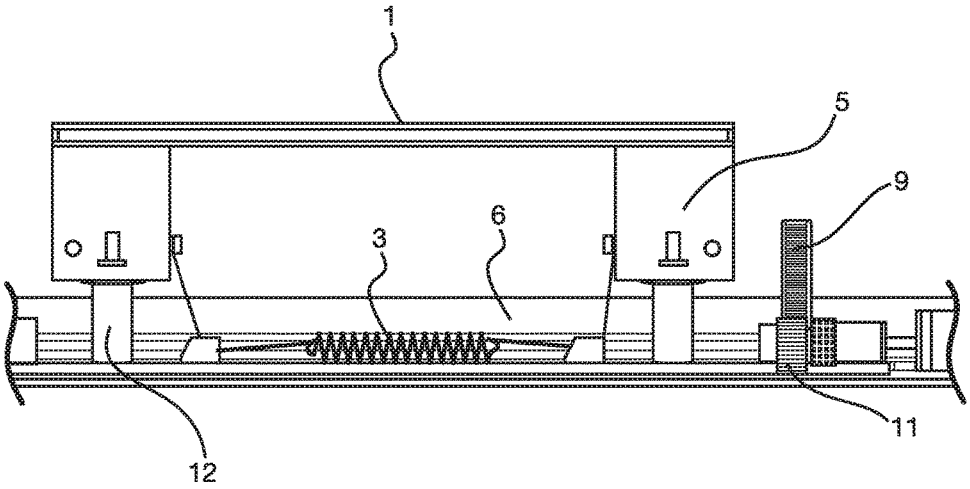
FIG. 14 shows same embodiment as FIG. 13 and shows handle (1), means (3), handle connector (5), base (6), rack (9), pinion (11), cradle connector (12).

FIGS. 6 through 12 show one preferred embodiment. This embodiment is meant for building into door body (2). Said handle assembly is comprised of handle (1), said handle attached to handle connector (5) which is movably connected to cradle connector (12) to allow relative movement between said handle connector (5) and said cradle connector (12). Said cradle connector (12) is connected to cradle (10), said cradle (10) attached to said door body (2). Said handle (1) is extended and/or retracted by means of rack-and-pinion gear comprising of at least one rack (9) and at least one pinion (11) engaged with said rack (9). Said pinion (11) is rotationally connected to driving means, preferably electromotor (8) by axle (7), and is attached to base (6). Said handle connector (5) is attached to said base (6) by means of flexible attachment means (3), in this preferred embodiment helical spring.

Said door handle assembly is put into operation by user providing command, usually by depressing button, breaking a beam connected to photo sensitive array, or by some other means. In such a case electromotor (8) starts to turn in the first direction, thereby turning axle (7), and pinion (11) connected thereto. Said pinion (11) engages with said rack (9) thereby extending said handle (1) away from said cradle (10). As said pinion (11) is attached to said base (6), said base (6) is moving with said pinion (11). Further, said base (6) is pushing said handle connector (5), and consequently said handle (1) attached to said handle connector (5) with it in its extended position until such time that said handle (1) is fully extended.

After user finishes using handle assembly said handle (1) is undergoing process of retraction, either automatically, with passing of time, or by again depressing button, or by some other suitable means. The retraction is opposite to extending—driving means preferably electromotor (8) rotates in the second direction, and rotates axle (7), and pinion (11) in order to retract said handle (1) back to its retracted position. As said pinion (11) is attached to said base (6), said base (6) is also retracting toward said cradle (10). Said base (6) is pulling along said handle connector (5) and consequently said handle (1) connected to said handle connector (5).

Door handle assembly according this invention is comprised of said handle connector (5), said base (6), an axle (7), driving means, preferably electromotor (8), at least one rack (9), a cradle (10), at least one pinion (11), a cradle connector (12), whereby said attachment means (3) are attaching said handle connector (5) to said base (6), and whereby said extending and/or retracting means are comprised of said driving means, preferably electromotor (8) connected to said axle (7) connected to said pinion (11) engaging with said rack (9), said extension of said handle (1) achieved by rotation of said driving means, preferably electromotor (8) in the first direction, and said retraction of said handle (1) achieved by rotation of said driving means, preferably electromotor (8) in the second direction, said pinion (11) connected to said base (6), whereby in case that during retraction said obstacle is inserted between said handle (1) and said recess into which said handle (1) is retracted, said base (6) continues to be retracted into said recess while said handle (1) remains essentially motionless until such time that said obstacle is removed thereby limiting amount of force exerted by said handle (1) on said obstacle, said attachment means (3) afterward pulling said handle (1) toward said base (6).

Door handle assembly according to this invention may feature at least one flexible attachment means (3) which is chosen from group of at least one helical spring, and at least one elastic band.

Door handle assembly according to this invention may feature extending and/or retracting means which are comprised of actuator, preferably hydraulic, within base connector (4).

A process for extending and/or retracting of door handle assembly performed by door handle assembly according to this invention is comprising steps of:

- extending handle (1) from its recess into extended position by extending means;
- using said handle (1);
- retraction said handle (1) from its extended position into said recess;
- in case that an obstacle is inserted between said handle (1) and said recess into which said handle (1) is retracted, said base (6) continues to be retracted into said recess while said handle (1) remains essentially motionless until such time that said obstacle is removed thereby limiting amount of force exerted by said handle (1) on said obstacle.

The invention claimed is:

1. A door handle assembly arranged on a fixed cradle mounted in a recess within a door surface, said fixed cradle having at least one perpendicular cradle connector, said door handle assembly comprising:

a) a handle;

b) at least one handle connector fixed to said handle, and slideably connected to said at least one perpendicular cradle connector;

c) a movable base supporting said at least one handle connector and movably connected to said at least one perpendicular cradle connector connector, wherein said moveable base moves in a fixed linear direction along said at least one perpendicular cradle connector;

d) a motivator arranged to move said moveable base out of said recess along said at least one perpendicular cradle connector; and, e) at least one flexible connector arranged to operatively connect said handle connector to said moveable base, said at least one flexible connector being configured to pull said handle downward when said moveable base is retracted into said recess, wherein presence of an external object between said handle and said door surface limits movement of said handle by extending said flexible connector as said moveable base moves downward.

2. The door handle assembly according to claim 1, wherein said flexible connector is chosen from group consisting of at least one helical spring, and at least one elastic band.

3. The door handle assembly according to claim 2, wherein said motivator is selected from a group consisting of an electric motor, a hydraulic actuator, compressed springs and a pneumatic actuator.

4. The door handle assembly according to claim 3, wherein said external object is attached to a user.

5. The door handle assembly according to claim 3, wherein said motivator comprises an electric motor operatively attached to a rack on said fixed cradle, said rack operatively interacting with a pinion on said movable base.

6. A method of operating a door handle assembly to avoid external objects being caught between an extendable door handle and a door surface containing said door handle within a recess, said method comprising the steps of:

a) extending said door handle from said recess in said door surface;

b) operating said door handle; and, c) initiating retraction of said door handle back into said recess, wherein an external object situated between said door handle and said door surface extends a flexible connector between said handle and a motivating platform to limit movement of said handle back into said recess while said external object is present between said handle and said door surface.

7. The method of claim 6, wherein said external object is attached to a user of said door handle.

8. The process of claim 7, wherein said door handle is extended and retracted by operation of an electric motor.

* * * * *